US006036731A

United States Patent [19]

Scheibli et al.

[11] Patent Number: 6,036,731

[45] Date of Patent: Mar. 14, 2000

[54] CROSSLINKING OF CELLULOSIC FIBER MATERIALS

[75] Inventors: Peter Scheibli, Bottmingen; Peter Aeschlimann, Allschwil, both of Switzerland

[73] Assignee: Ciba Specialty Chemicals Corporation, Tarrytown, N.Y.

[21] Appl. No.: 09/081,429

[22] Filed: May 19, 1998

[30] Foreign Application Priority Data

Jun. 4, 1997 [CH] Switzerland ..... 1337/97

[51] Int. Cl.[7] ..... D06P 1/54; D06P 3/66; D06M 13/322

[52] U.S. Cl. ..... 8/541; 8/543; 8/190; 544/208; 544/209; 544/211

[58] Field of Search ..... 8/543–549, 541, 8/542, 190; 544/208, 209, 211

[56] References Cited

U.S. PATENT DOCUMENTS

| | | | |
|---|---|---|---|
| 2,892,674 | 6/1959 | Sause et al. | 8/190 |
| 3,124,414 | 3/1964 | Dolmetsch | 8/116.2 |
| 4,313,732 | 2/1982 | Teague et al. | 8/541 |
| 4,548,902 | 10/1985 | Hasler et al. | 436/2 |

FOREIGN PATENT DOCUMENTS

| | | |
|---|---|---|
| 0538977 | 4/1993 | European Pat. Off. . |
| 0691426 | 1/1996 | European Pat. Off. . |
| 54-30999 | 3/1979 | Japan . |
| 869660 | 6/1961 | United Kingdom . |
| 94/09191 | 4/1994 | WIPO . |
| 94/20656 | 9/1994 | WIPO . |
| 95/00697 | 1/1995 | WIPO . |
| 95/28516 | 10/1995 | WIPO . |
| 95/30043 | 11/1995 | WIPO . |
| 96/28601 | 9/1996 | WIPO . |

OTHER PUBLICATIONS

Trotman, E.R., Dyeing and Chemical Technology of Textile Fibres, Capter 22, 1984.

Derwent Abstract 83199W/51 for BE 829673.

*Primary Examiner*—Yogendra Gupta
*Assistant Examiner*—Christine E Ingersoll
*Attorney, Agent, or Firm*—Kevin T. Mansfield

[57] ABSTRACT

The process for crosslinking cellulosic fiber materials, especially cellulosic fiber materials which are 20 to 100% by weight natural or regenerated cellulose fibers, comprises applying to the cellulosic fiber materials in which the cellulosic fibers comprise natural or regenerated cellulose at least one product of the general formula (1)

$$A\text{—}[R]_n, \quad (1)$$

where A is a colorless aliphatic, aromatic or heteroaromatic radical, R is a fiber-reactive radical and n is 1, 2, 3 or 4, with the proviso that the radical $[R]_n$ includes at least two fiber-reactive groups, and is useful for achieving permanent finish effects, for example in the area of easy care, dimensional stability and shrink resistance.

6 Claims, No Drawings

CROSSLINKING OF CELLULOSIC FIBER MATERIALS

The present invention relates to a process for crosslinking cellulosic fibre materials. Cellulosic fibre materials are crosslinked to impart to them permanent finishing effects, for example in the area of crease resistance, easy care, dimensional stability and shrink resistance.

It is known to treat cellulosic fibre materials, such as textiles, with products conferring permanent finish effects, for example shrinkage and crease resistance. Products used for this purpose include, for example, products obtained by addition of formaldehyde to amide groups. These N-methylol compounds normally still comprise remnants of free formaldehyde and they detach formaldehyde to a certain extent on being subjected to a thermal treatment, which may lead to odour nuisance and intolerance. This disadvantage of N-methylol compounds can be reduced or circumvented by using low-formaldehyde or formaldehyde-free products as crosslinkers for cellulose. Contemplated products have etherified N-methylol groups or contain no —N—$CH_2$—O— groups at all. An example of the latter class of compounds are N,N'-dialkyl4,5-dihydroxyimidazolidinones (N,N'-dialkyldihydroxyethyleneureas), which are obtainable by reacting N,N'-dialkylureas with glyoxal. Similarly, etherification products of the lastmentioned compounds with polyhydric alcohols are known as crosslinkers for cellulosic materials.

The disadvantage of prior art formaldehyde-free cellulose crosslinkers is that the desired effect level is not achieved in all cases. In addition, known products generally require temperatures of about 160° C. or higher for adequate crosslinking reaction with cellulose, which is undesirable. Prior art formaldehyde-free crosslinkers, moreover, require relatively high or very high use levels and add-ons and frequently lead to undesirable yellowing of the treated fibre materials.

It is an object of the present invention to provide a process for crosslinking cellulosic fibre materials, for example in order that highly effective formaldehyde-free finishing of fibre materials may be achieved, which does not have the disadvantages described. The process shall make it possible to carry out the reaction of the crosslinker with the cellulose (curing) at comparatively low temperatures, i.e. temperatures of less than 150° C., and shall lead to a higher level of the crease resistance or easy care effect than hitherto possible using known formaldehyde-free crosslinkers.

This object is achieved by a process for crosslinking cellulosic fibre materials, especially cellulosic fibre materials which are 20 to 100% by weight natural or regenerated cellulose, which comprises applying to the cellulosic fibre materials in which the cellulosic fibres comprise natural or regenerated cellulose at least one product of the general formula (1)

$$A\text{—}[R]_n, \tag{1}$$

where A is a colourless aliphatic, aromatic or heteroaromatic radical, R is a fibre-reactive radical and n is 1, 2, 3 or 4, with the proviso that the radical $[R]_n$ includes at least two fibre-reactive groups.

A is preferably an aromatic radical which may be unsubstituted or substituted by $C_1$–$C_4$alkyl, e.g. methyl or ethyl, $C_1$–$C_4$alkoxy, e.g. methoxy or ethoxy, halogen, e.g. fluorine, bromine or especially chlorine, carboxyl or preferably one or more water-solubilizing groups. Suitable water-solubilizing groups include especially sulfo groups (—$SO_3H$). An aromatic radical A is preferably a benzene radical which may be substituted by one or two sulfo groups. The aromatic radical A may preferably also be free from water-solubilizing groups if at least one of the radicals R contains a water-solubilizing group, for example a sulfato group.

Aliphatic A can be, for example, a $C_1$–$C_{18}$alkyl radical, preferably a $C_2$–$C_{12}$alkyl radical, which may be interrupted by one or more heteroatoms, e.g. oxygen, and which may be substituted by one or more water-solubilizing groups. Examples of suitable water-solubilizing groups are sulfo groups and hydroxyl groups.

Hetaromatic A is, for example, a morpholino, pyrimidine or triazine radical which may be substituted, for example by halogen.

Fibre-reactive radicals are radicals capable of reacting with the hydroxyl groups of cellulose, the amino, carboxyl, hydroxyl or thiol groups in the case of wool and silk or with the amino and possibly carboxyl groups of synthetic polyamides with the formation of covalent chemical bonds. Fibre-reactive groups are generally attached directly or via a bridge member to the colourless radical A. Examples of suitable fibre-reactive groups include those which contain at least one detachable substituent on an aliphatic, aromatic or heterocyclic radical or in which the radicals mentioned contain a radical suitable for reaction with the fibre material, for example a triazine radical.

Examples of fibre-reactive groups include fibre-reactive radicals containing carbo- or heterocyclic 4-, 5- or 6-rings substituted by a detachable atom or group. Examples of heterocyclic radicals include heterocyclic radicals which contain at least one detachable substituent attached to a heterocyclic ring; and those which contain at least one reactive substituent attached to a 5- or 6-membered heterocyclic ring, as to a monoazine, diazine, triazine, pyridine, pyrimidine, pyridazine, pyrazine, thiazine, oxazine or asymmetrical or symmetrical triazine ring. The heterocyclic fibre-reactive radicals mentioned may further contain, via a direct bond or via a bridge member, further fibre-reactive radicals, such as the recited radicals, for example.

Fibre-reactive groups further include those having at least one activated unsaturated group, especially an unsaturated aliphatic group, for example a vinyl, halovinyl, styryl, acryloyl or methacryloyl group, or at least one polymerizable ring system. Examples of such groups are halogen-substituted unsaturated groups, such as halomaleic acid and halopropiolic acid radicals, α- or β-bromo- or -chloroacryloyl groups, halogenated vinylcetyl groups, halocrotonyl or halomethacryloyl groups. Also suitable are groups which, for example through detachment of hydrogen halide, are readily converted into halogen-containing unsaturated groups, for example dichloro- or dibromo-propionyl. Halogen is here to be understood as meaning not only fluorine, chlorine, bromine and iodine atoms but also pseudohalogen atoms, for example cyano. The process of the present invention provides good results on utilizing compounds containing an α-bromoacryloyl group. Among compounds containing a polymerizable double bond, preference is given to those containing at least one acryloyl, methacryloyl, α-bromoacryloyl, α-chloroacryloyl, vinyl or vinylsulfonyl radical; most preferably to those containing at least one acryloyl, α-bromoacryloyl or vinylsulfonyl radical.

Examples of further detachable atoms or groups are ammonium, including hydrazinium, sulfato, thiosulfato, phosphato, acetoxy, propionoxy or carboxypyridinium.

In the formula (1), the one to four reactive radicals are not necessarily all attached to the radical A; instead, it is also possible for two or three reactive radicals to be attached to each other directly or via bridge members.

The bridge member between the colourless radical A and the fibre-reactive radical or between two or three fibre-reactive radicals can be not only a direct bond but also one of a very wide variety of radicals. The bridge member is, for example, an aliphatic, aromatic or heterocyclic radical; the bridge member can also be assembled from various such radicals. The bridge member can contain at least one functional group, for example carbonyl or amino, in which case the amino group may be further substituted by unsubstituted or halogen-, hydroxyl-, cyano-, $C_1$–$C_4$alkoxy-, $C_1$–$C_4$alkoxycarbonyl-, carboxyl-, sulfamoyl-, sulfo- or sulfato-substituted $C_1$–$C_4$alkyl. An example of a suitable aliphatic radical is an alkylene radical having 1 to 7 carbon atoms or a branched isomer thereof. The carbon chain of the alkylene radical may be interrupted by a heteroatom, for example an oxygen atom. An example of a suitable aromatic radical is a phenyl radical which may be substituted by $C_1$–$C_4$alkyl, e.g. methyl or ethyl, $C_1$–$C_4$alkoxy, e.g. methoxy or ethoxy, halogen, e.g. fluorine, bromine or especially chlorine, carboxyl or sulfo, and an example of a suitable heterocyclic radical is a piperazine radical. Examples of such bridge members are the following radicals:

—CO—N($R_1$)—$(CH_2)_{2-3}$—; —CO—N($R_1$)—$(CH_2)_2$—O—$(CH_2)_2$—; —N($R_1$)—CO—$(CH_2)_3$—; —N($R_1$)—; —N($R_1$)—$(CH_2)_2$—O—$(CH_2)_2$—; —O—$(CH_2)_2$—; —$CH_2$—N($R_1$)—;

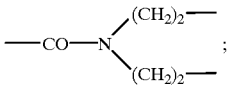

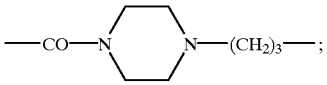

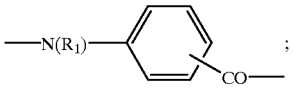

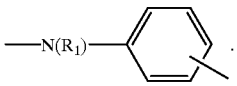

In the above-indicated formulae, $R_1$ is hydrogen or $C_1$–$C_4$alkyl which may be substituted by halogen, hydroxyl, cyano, $C_1$–$C_4$alkoxy, $C_1$–$C_4$alkoxycarbonyl, carboxyl, sulfamoyl, sulfo or sulfato.

The radicals A and $[R]_n$ in the formula (1) are preferably attached to each other via a bridge member containing the amino group —N(R1)—, particularly preferably via the bridge member —N(R1)—, where R1 is as defined above.

The proviso that the radical $[R]_n$ contain at least two fibre-reactive groups means that the compound of the formula (1) contains at least two of the fibre-reactive groups mentioned, for example, for n=1, a dichloro- or difluorotriazine radical which has two detachable halogen atoms which are both capable of reacting with the cellulose fibre or when n=2, for example, a 4-monochloro- or 4-monofluorotriazin-2-yl radical containing in position 6 a fibre-reactive group, for example a vinylsulfonyl group, which is attached directly or via a bridge member.

Important reactive radicals R contain one or two fluoro- or chlorotriazine groups and optionally an aliphatic reactive group, especially of the vinylsulfonyl type, or contain two vinylsulfonyl reactive radicals. In important compounds of the formula (1), the colourless reactive radical A is an unsubstituted or sulfo-substituted benzene radical and the fibre-reactive radical R comprises one or two fluoro- or chlorotriazine groups which are attached via a bridge member and which contain a further reactive radical, especially a vinylsulfonyl radical, via a bridge member. In further important compounds of the formula (1), the colourless radical A is an unsubstituted or sulfo-substituted benzene radical and the fibre-reactive radical R comprises two vinylsulfonyl radicals attached directly or via a bridge member.

Interesting reactive groups are 1,3,5-triazine radicals of the formula (2)

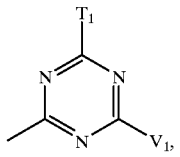

where $T_1$ is fluorine, chlorine or carboxypyridinium, and the substituent $V_1$ or the triazine ring is fluorine, chlorine, —$NH_2$, a $C_1$–$C_6$alkylamino, N,N-di-$C_1$–$C_6$alkylamino, cyclohexylamino, N,N-dicyclohexylamino, benzylamino, phenethylamino, phenylamino, naphthylamino, N—$C_1$–$C_6$alkyl-N-cyclohexylamino or N—$C_1$–$C_6$alkyl-N-phenylamino radical, or is morpholino, piperidino, piperazino, hydrazino or semicarbazido, or is an amino group substituted by a furan, thiophene, pyrazole, pyridine, pyrimidine, quinoline, benzimidazole, benzothiazole or benzoxazole radical. The aforementioned alkyl, cycloalkyl, aralkyl and aryl radicals and also the heterocyclic radicals may be further substituted, for example by $C_1$–$C_4$alkyl, e.g. methyl or ethyl, $C_1$–$C_4$alkoxy, e.g. methoxy or ethoxy, halogen, e.g. fluorine, bromine or especially chlorine, carboxyl or sulfo. The above-indicated proviso that the radical $[R]_n$ contain at least two fibre-reactive groups means that $V_1$ is fluorine or chlorine when n=1 and R is a radical of the formula (2).

$V_1$ in the formula (2) is particularly preferably fluorine, chlorine, phenylamino or N—$C_1$–$C_4$alkyl-N-phenylamino, where the phenyl rings may be substituted by halogen, such as fluorine, chlorine or bromine, nitro, cyano, trifluoromethyl, sulfamoyl, carbamoyl, $C_1$–$C_4$alkyl, $C_1$–$C_4$alkoxy, acylamino groups, such as acetylamino or benzoylamino, ureido, hydroxyl, carboxyl, sulfomethyl or especially sulfo.

Interesting fibre-reactive radicals also include, for example, those of the formula (2')

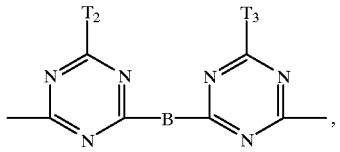

where $T_2$ and $T_3$ are independently fluorine, chlorine or carboxypyridinium and B is a bridge member.

Bridge member B in the formula (2') can be, for example, a radical of the formula

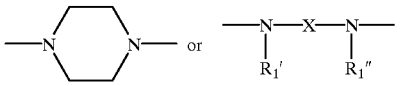

where $R_1'$ and $R_1''$ are independently hydrogen or unsubstituted or halogen-, hydroxyl-, cyano-$C_1$–$C_4$alkoxy-, $C_1$–$C_4$alkoxycarbonyl-, carboxyl-, sulfamoyl-, sulfo- or sulfato-substituted $C_1$–$C_4$alkyl and X is an unsubstituted or hydroxyl-, sulfo-, sulfato-, $C_1$–$C_4$alkoxy-, carboxyl- or halogen-substituted $C_2$–$C_6$alkylene or $C_5$–$C_9$cycloalkylene radical or is an unsubstituted or $C_1$–$C_4$alkyl-, $C_1$–$C_4$alkoxy-, sulfo-, halogen- or carboxyl-substituted phenylene, biphenylene or naphthylene radical.

Further interesting reactive groups are those of the formula (3)

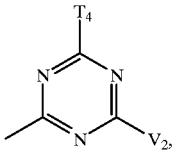

where $T_4$ is fluorine, chlorine or carboxypyridinium and $V_2$ is a radical of the formula (4)

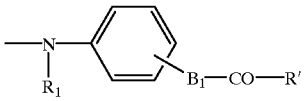

where $R_1$ is hydrogen or $C_1$–$C_4$alkyl which may be substituted by halogen, hydroxyl, cyano, $C_1$–$C_4$alkoxy, $C_1$–$C_4$alkoxycarbonyl, carboxyl, sulfamoyl, sulfo or sulfato; $B_1$ is a direct bond or a radical

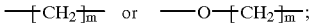

m is 1, 2, 3, 4, 5 or 6; and R' is a radical of the formula (4a)

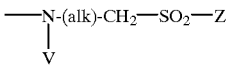

(4b)

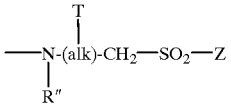

(4c)

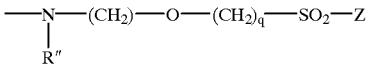

(4d)

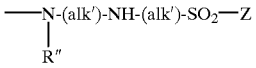

-continued (4e)

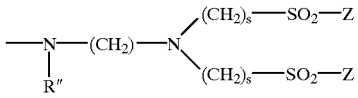

(4f)

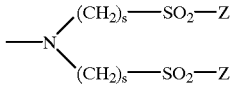

or (4g)

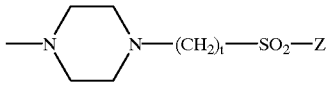

where R" is hydrogen or $C_1$–$C_6$alkyl, alk is an alkylene radical having 1 to 7 carbon atoms, T is hydrogen, halogen, hydroxyl, sulfato, carboxyl, cyano, $C_1$–$C_4$alkanoyloxy, $C_1$–$C_4$alkoxycarbonyl, carbamoyl or a radical —$SO_2$—Z, V is hydrogen, substituted or unsubstituted $C_1$–$C_4$alkyl or a radical of the formula (4h)

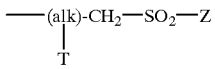

where (alk) is as defined above, each alk' is independently a polymethylene radical having 2 to 6 carbon atoms, Z is β-sulfatoethyl, β-thiosulfatoethyl, β-phosphatoethyl, β-acyloxyethyl, β-haloethyl or vinyl, r and t are each independently 1, 2, 3, 4, 5 or 6 and s is 2, 3, 4, 5 or 6; and the benzene ring in the formula (4) may contain further substituents; or where $V_2$ is a directly attached radical of the formula (4a), (4b), (4c), (4d), (4e), (4f) or (4g) where R', T, alk, V, alk', Z, p, q, r, s and t are each as defined above; or where $V_2$ is a radical of the formula (4')

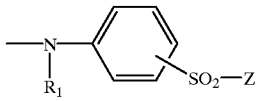

where $R_1$ and Z are each as defined above and the benzene ring may be further substituted.

Further possible substituents for the benzene rings of the compounds of the formulae (4) and (4') are halogen, such as fluorine, chlorine or bromine, nitro, cyano, trifluoromethyl, sulfamoyl, carbamoyl, $C_1$–$C_4$alkyl, $C_1$–$C_4$alkoxy, acylamino groups, such as acetylamino or benzoylamino, ureido, hydroxyl, carboxyl, sulfomethyl and sulfo.

The radical $B_1$ contains 1 to 6, preferably 1 to 4, carbon atoms. Examples of $B_1$ are methylene, ethylene, propylene, butylene, methyleneoxy, ethyleneoxy, propyleneoxy and butyleneoxy. When $B_1$ is

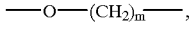

it attaches to the benzene ring by the oxygen atom. $B_1$ is preferably a direct bond.

β-Haloethyl Z is preferably β-chloroethyl and β-acyloxyethyl Z is preferably β-acetoxyethyl. The alkylene radical alk is preferably methylene, ethylene, methylmethylene, propylene or butylene. Alkanoloxy T is especially acetyloxy, propionyloxy or butyryloxy, and alkoxycarbonyl T is especially methoxycarbonyl, ethoxycarbonyl or propyloxycarbonyl. Alkyl V can be methyl, ethyl, propyl, isopropyl, butyl, isobutyl, sec-butyl or tert-butyl. Examples of R" are methyl, ethyl, propyl, isopropyl, butyl, isobutyl, sec-butyl, tert-butyl, pentyl, hexyl and, preferably, hydrogen. The polymethylene radicals alk' are preferably ethylene, propylene or butylene. The index t is preferably 2, 3 or 4. The indices r and s are independently preferably 2.

Preferred radicals $V_2$ are those of the formula (4) where $B_1$ is a direct bond and R is a radical of the formula (4a), or where $V_2$ is a radical of the formula (4b), (4c) or (4f) which is directly attached to the triazine ring, or where $V_2$ is a radical of the formula (4').

Also of interest are reactive groups of the formulae (4i)

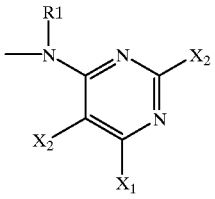

(4j)

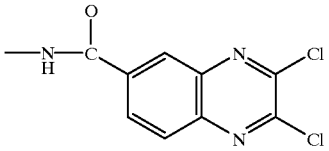

(4k)

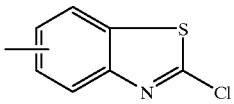

(4l)

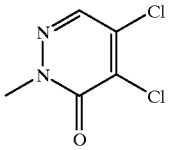

where $R_1$ is as defined above and $X_1$ and $X_2$ are both chlorine, or $X_1$ is chlorine and $X_2$ is fluorine, with the proviso that the radical $[R]_n$ in the formula (1) contains at least two fibre-reactive groups.

Preferred aliphatic reactive groups are those of the formulae

| | |
|---|---|
| $—SO_2Z$ | (5a), |
| $—SO_2—NH—Z$ | (5b), |
| $—NH—CO—(CH_2)_3—SO_2Z$ | (5c), |
| $—CO—NH—CH_2CH_2—SO_2Z$ | (5d) and |
| $—NH—CO—Z_1$ | (5e), |

where Z is defined above, $Z_1$ has the meanings of Z and can additionally be halomethyl or α,β-dihaloethyl.

The halogen in halomethyl, β-haloethyl or α,β-dihaloethyl $Z_1$ is suitably in particular chlorine or bromine.

Particularly preferred aliphatic reactive groups are those of the formula (5a) and also those of the formulae (5c) and (5d). Here Z is in particular β-sulfatoethyl or β-haloethyl.

Preference is given to compounds of the formula (1a)

(1a)

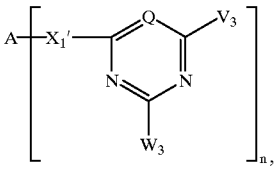

where Q is the radical C—Y or is especially a nitrogen atom, Y is chlorine, $V_3$ and $W_3$ are each independently fluorine, chlorine, $R_2—X_2'—$, $R_3—X_3'$ or hydroxyl, $R_2$ and $R_3$ are each independently a colourless aliphatic and especially a $C_1–C_8$alkyl radical with or without interruption by oxygen atoms, an aromatic radical, especially an unsubstituted or $C_1–C_4$alkyl-, $C_1–C_4$alkoxy-, halogen- or sulfo-substituted phenyl radical, or a heteroaromatic radical, $X_1'$, $X_2'$ and $X_3'$ are each independently, —S—, $—N(R_4)—$, —NH—CO-phen-NH— or —NH—CO-phen-CO—NH—, $R_4$ is hydrogen, $C_1–C_5$alkyl, $C_5–C_6$cycloalkyl or phenyl, phen is an unsubstituted or substituted phenylene group, and n is 1, 2, 3 or 4, with the proviso that the radical $[R]_n$ in the formula (1a) contain at least two fibre-reactive groups. A in the formula (1a) is as defined under the formula (1).

Preferred compounds of the formula (1a) where A is an aliphatic radical conform, for example, to the formula (6)

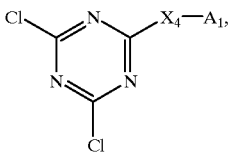

where $X_4$ is $—NR_5—$ or —S—, $A_1$ is an aliphatic radical having 1 to 18 carbon atoms which is free of sulfo groups, and $R_5$ is hydrogen or $C_1–C_4$alkyl or has the meanings of $A_1$ independently of $A_1$.

An aliphatic radical $A_1$ with 1 to 18 carbon atoms is, for example, a $C_1–C_{18}$alkyl radical, for example methyl, ethyl, n-propyl, isopropyl, n-butyl, sec-butyl, tert-butyl, isobutyl, pentyl, hexyl, heptyl, octyl, nonyl, decyl, dodecyl, tetradecyl, hexadecyl, heptadecyl or octadecyl, in which case the alkyl radical can be substituted, for example by hydroxyl or alkoxy, and in which case the alkyl chain can be singly or multiply interrupted, for example by oxygen, sulfur, amino, carboxamido, aminocarbonyl, ureido, sulfonamido, aminosulfonyl, carboxyl and carbonyloxy.

$C_1–C_4$Alkyl $R_5$ is methyl, ethyl, n-propyl, isopropyl, n-butyl, sec-butyl, tert-butyl or isobutyl.

$A_1$ is preferably linear or branched $C_1–C_{18}$alkyl, especially $C_1–C_8$alkyl substituted by $—OR_6$, in which case the alkyl chain may be interrupted by one or more radicals —Q—, or is linear or branched $C_1–C_{18}$alkyl, especially $C_1–C_8$alkyl, in which case the alkyl chain is interrupted by one or more radicals $—Q_1—$, where $—Q_1—$ is —O—, —S—, $—NR_7—$, $—CONR_7—$, $—NR_7CO—$, $—NR_7—CO—NR_7—$, $—SO_2NR_7—$, $—NR_7SO_2—$, —COO—, —OCO—, $—NR_7COO—$ or —OCOO—, $R_6$ is hydrogen or $C_1–C_4$alkyl and $R_7$is hydrogen or $C_1–C_4$alkyl.

$C_1–C_{18}$Alkyl or $C_1–C_8$alkyl $A_1$ may be optionally further substituted by one or more substituents, for example by carboxyl, carboxamido or sulfonamido.

$X_4$ is preferably $—NR_5—$.

$R_5$ is preferably methyl and particularly preferably hydrogen.

$C_1$–$C_4$Alkyl $R_4$ is methyl, ethyl, n-propyl, isopropyl, n-butyl, sec-butyl, tert-butyl or isobutyl.

$C_1$–$C_4$Alkyl $R_7$ is methyl, ethyl, n-propyl, isopropyl, n-butyl, sec-butyl, tert-butyl or isobutyl.

$R_6$ is preferably methyl and particularly preferably hydrogen.

$R_7$ is preferably hydrogen.

—$Q_1$— is preferably —O—, —S— or —NH—.

Of particular interest for the process of the present invention are compounds of the formula (6) where —$X_4$—$A_1$ represents the following radicals:

—$NHCH_2CH_2SCH_2CH_2OH$,
—$NHCH_2CH_2CONHCH_2CH_2OH$,
—$NHCH_2CH_2CH_2CONHCH_2CH_2OH$,
—$NHCH_2CH_2CH_2CONHCH_2CH_2CH_2OH$,
—$NHCH_2CONHCH_2CH_2CH_2OH$, —$NHCH_2CON(CH_2CH_2OH)_2$,
—$NHCH_2CH_2NHCOCH_2CH_2CH_2OH$,
—$NHCH_2CH_2CH_2NHCOCH_2CH_2CH_2OH$,
—$NHCH_2CH_2CH_2CONHCH_2CH_2CH_2OH$.

Of particular importance for the process of the present invention are the compounds of the formulae (6a)

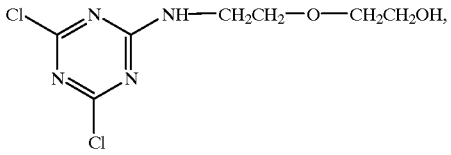

(6b)

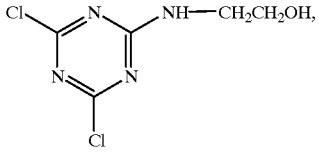

(6c)

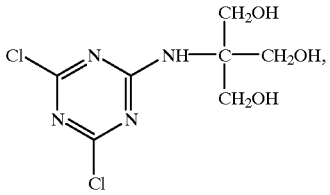

(6d)

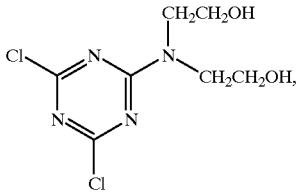

(6e)

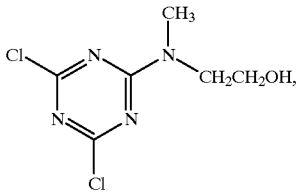

-continued (6f)

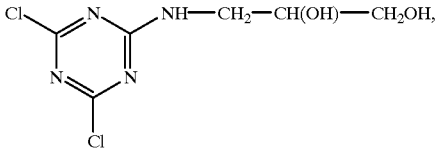

(6g)

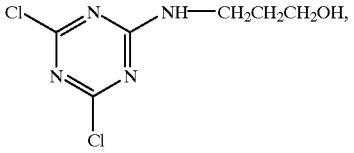

(6h)

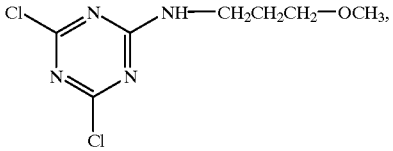

(6i)

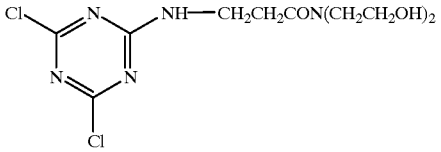

(6j)

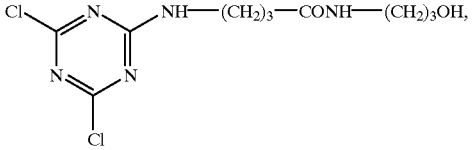

(6k)

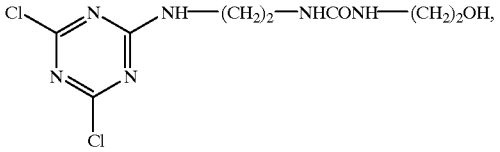

(6l)

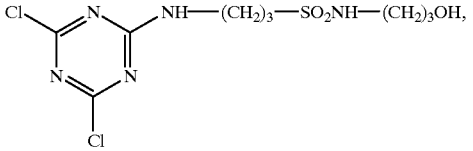

(6m)

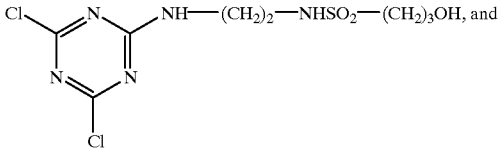

(6n)

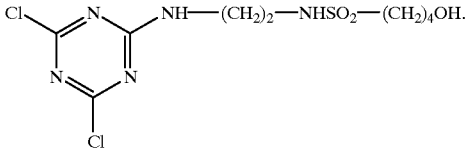

The compounds of the formulae (6f) and (6g) are most important for the process of the present invention.

The compounds of the formula (6) used in the process of the present invention are prepared in a conventional manner, for example by reacting a trichlorotriazine of the formula (7)

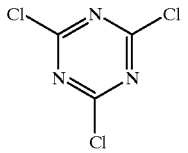

with an equimolar amount of a compound of the formula $$HX_4—A_1 \quad (8),$$

where $X_4$ and $A_1$ are each as defined under the formula (6), and isolating the resulting end product of the formula (6).

The novel compounds of the formulae (6a) to (6n) are prepared in a similar manner by reacting a trichlorotriazine of the formula (7) with, for example, an amine of the formula

| | |
|---|---|
| $NH_2—CH_2CH_2OCH_2CH_2OH$ | (8a), |
| $NH_2—CH_2CH(OH)CH_2OH$ | (8b), |
| $NH_2—CH_2CH_2CON(CH_2CH_2OH)_2$ | (8c), |
| $NH_2—CH_2CH_2CH_2CONHCH_2CH_2CH_2OH$ | (8d), |
| $NH_2—CH_2CH_2NHCONHCH_2CH_2OH$ | (8e), |
| $NH_2—CH_2CH_2CH_2SO_2NHCH_2CH_2CH_2OH$ | (8f), |
| $NH_2—CH_2CH_2NHSO_2CH_2CH_2CH_2OH$ | (8g) or |
| $NH_2—CH_2CH_2NHSO_2CH_2CH_2CH_2CH_2OH$ | (8h). |

The amines of the formulae (8a) to (8h) are either known or preparable by known methods.

It is most preferable for compounds of the formula (1) to contain at least one reactive group of the formulae (2), (2'), (3), (4i) to (4l), (5a) to (5e) and (6), where A, $A_1$ $R_1$, $T_1$, $T_2$, $T_3$, $T_4$, $V_1$, $V_2$, B, $X_1$, $X_2$, $X_4$, Z and $Z_1$ are each subject to the above definitions and preferences. Of particular interest are those compounds of the formula (1) which contain at least one reactive group of the formulae (2), (2'), (3), (4i) to (4l) and (5a) to (5e), where $R_1$, $T_1$, $T_2$, $T_3$, $T_4$, $V_1$, $V_2$, B, $X_1$, $X_2$, Z and $Z_1$ are each subject to the above definitions and preferences.

Very particular preference is further given to compounds of the formula (1b)

(1b)

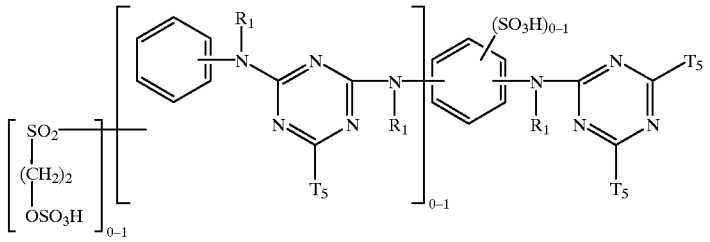

where $T_5$ is fluorine or especially chlorine and $R_1$ is hydrogen, methyl or ethyl.

Further compounds preferred in the process of the present invention conform to the formula (1c)

(1c)

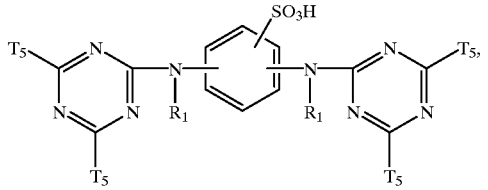

where $T_5$ and $R_1$ are each as defined under the formula (1b). In a particularly preferred embodiment of the process of the present invention, $T_5$ is chlorine and $R_1$ is hydrogen in the compound of the formula (1c) used. More particularly, the two —$NR_1$— groups are disposed meta or para on the benzene nucleus.

The process of the present invention is preferably carried out using compounds of the formula (1d)

where $A_2$ is an unsubstituted or sulfo-substituted benzene radical, $R_{10}$ is a radical of the formula (2), (2), (2') or (3), or where $R_{10}$ is an —$SO_2$—Z radical, where Z is as defined above, and n is 1, 2, 3 or 4, with the proviso that the radical $[R_{10}]_n$ contains at least two fibre-reactive groups.

When A is a heteroaromatic radical, further interesting compounds for use in the process of the present invention conform to the formula (1e)

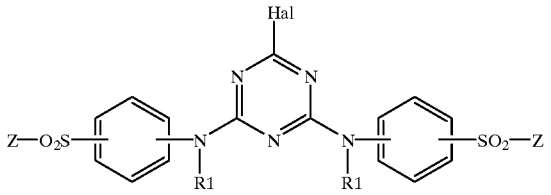

where $R_1$ and Z are each as defined under the formula (4) or (4h), respectively, and Hal is halogen, preferably chlorine. In the formula (1e), Hal is especially chlorine, $R_1$ is hydrogen and —$SO_2$—Z is disposed meta or para to the amino group and is β-sulfatoethylsulfonyl.

The process of the present invention is useful for achieving permanent finish effects, especially for improving crease resistance, easy care properties, dimensional stability and shrink resistance of fibre materials comprising not less than 20% by weight of natural or regenerated cellulose fibres. When the proportion of cellulose fibre is less than 20% by weight, the effect of the finish is too small to bring out the advantages of the process. The fibre materials may include cellulose fibres in a blend with other fibres, especially composed of polyester or polyamide, or they can consist exclusively of cellulose fibres. Suitable cellulose fibres include not only natural fibres such as cotton but also fibres composed of regenerated cellulose, for example viscose rayon staple. Also suitable are modal fibres, for example polynosic fibres, and cupro fibres. Lyocell fibre is not used in the process of the present invention.

Suitable fibre materials for treatment, especially aftertreatment, via the process of the present invention are especially textile wovens or knits. Also contemplated, however, are yarns whose tensile strength can be increased by application of the process of the present invention. An important and preferred field of use for the process of the present invention is terry towelling material. High quality terry towelling shows reduced fibre shedding, especially after application in laundry dryers. In the case of viscose fibres, the process of the present invention can prevent or at least reduce any change to the fibre surface, for example due to the dyeing process.

The process of the present invention has a number of advantages. The fibre materials to which the abovementioned products have been applied need only be dried at 80 to 130° C. to obtain good easy care effects. Temperatures of up to 150° C. or more, as are necessary in the case of known formaldehyde-free crosslinkers, need not be employed. In the process of the present invention, an alkaline crosslinker liquor can also be applied by the wet batch technique whereby, after application and a pinching process, for example in the course of pad-mangling, the fibre material, for example in the form of a textile fabric, is stored at room temperature in a state where it is protected against drying out and, after a certain dwell time of, for example, 20 hours, rinsed with water and dried. At least partial crosslinking takes place during the residence in the wet state.

The process of the present invention can also be used to reduce dry pilling, especially important in the case of furniture cover fabrics.

After application of the crosslinker in the wet crosslinking process, the finished and dried fibre materials frequently exhibit better whiteness than in the case of the use of known processes involving thermofixing. In addition, the rotting resistance of the finished fibre materials is frequently appreciably better than in known processes. The process of the present invention, moreover, is advantageously combined with other processes, for example with a reactive dyeing in an alkaline medium or other processes which are carried out in an alkaline medium. The combination of the process of the present invention with the dyeing and fixing of reactive dyes is of immense advantage. The process of the present invention, moreover, frequently offers the advantage of less impairment to the lightfastness of direct and reactive dyeings than is the case in existing processes.

In the process of the present invention, the fibre materials, which are preferably textile wovens or knits, have applied to them at least one product of the formula (1). However, it is also possible to apply mixtures of a plurality of products falling within the formula (1). In addition, further desired products can be applied to these fibre materials at the same time as one or more products of the formula (1), for example water repellants, oil repellants or flame retardants.

The application of such product mixtures can be effected by means of a single treatment liquor, for example by means of pad-mangling, in which case the wet pick-up is generally not less than 50%, preferably 60 to 80%, when these product mixes are homogeneous mixtures. It is particularly advantageous for economic and ecological reasons to carry out the process of the present invention in such a way that a product of the formula (1) or product mix is applied to the fibre materials in the form of an alkaline aqueous solution or dispersion of this product or these products and the fibre materials are subsequently dried. They are preferably dried within the temperature range from 80 to 130° C., for example by means of hot air; if necessary, however, other temperatures can be employed as well, for example up to 140° C. As well as the aforementioned addition of other products to the treatment liquor, a preferred embodiment of the process of the present invention includes a reactive dyeing as well, in a single operation. In this case, the treatment liquor comprises a reactive dye as well as one or more products of the formula (1) and optionally further products. This preferred embodiment of the process of the present invention is contemplated especially for alkaline treatment liquors whose pH is preferably within the range from 7 to 13 at 20° C.

With regard to the stability of the solutions or dispersions, it is normally advantageous for the solutions or dispersions, preferably aqueous solutions or dispersions, to be used in the process of the present invention to have a pH in storage which is not below 7.0 and not above 10.0, in some cases not above 9.0. The desired pH, for example within the range from 7 to 10, can be set or stabilized with $Na_2CO_3$, $K_2CO_3$, $KHCO_3$ or $NaHCO_3$, for example. The amount of alkali, for example NaOH or KOH, required for treating the fibre materials (crosslinking reaction with cellulose) and/or for the reactive dyeing should not be added until shortly before use.

The metal salts which are present in the alkaline aqueous medium and which come within the scope of the formula (1) and are useful for the process of the present invention can be salts of monovalent or polyvalent metal cations. Particularly preferred monovalent metals or metal cations are sodium and potassium. The sodium or potassium salts of the water-soluble compounds of the formula (1) are particularly preferred. A preferred embodiment of the process of the present invention thus comprises using water-soluble products of the formula (1); these water-soluble products are in particular sodium or potassium salts which are used in aqueous finishing liquors. If only these sodium or potassium salts are used, they are preferably alkaline aqueous solutions. In the presence of other additives which are water-insoluble but water-dispersible, the process of the present invention is preferably carried out using aqueous dispersions. The dispersants required for dispersing such additional finishing agents in water are known to one skilled in the art. The aqueous dispersions, which comprise further products as well as at least one compound of the formula (1) likewise preferably have an alkaline pH within the range from pH 7 to 13.

The treatment of the fibre materials by the process of the present invention can be carried out by commonly known methods. It is particularly advantageous to apply solutions or dispersants comprising at least one product of the formula (1) by pad-mangling. This treatment is preferably carried out with an aqueous liquor comprising 1 to 12% by weight, based on total liquor, of one or more products of the formula (1). Normally, the fibre material comprises about 1 to 6% by weight of a product of the formula (1), based on the total weight of the finished fibre material, after the subsequent pinching. The subsequent drying can be carried out in known apparatus, for example by means of hot air, and is preferably carried out within the temperature range from 80 to 130° C. A temperature gradient can be present during the drying process. The drying is accompanied by a reaction (crosslinking) of product of the formula (1) with cellulose. This reaction is achieved by the presence of an alkaline pH. As well as drying with hot air, it is also possible to treat with saturated steam at temperatures between 98 and 105° C., for example, or to combine the hot air treatment with the saturated steam treatment.

The crosslinking with the OH groups of the cellulose is thus achieved by the presence of alkaline compounds. Even if alkaline compounds of the formula (1), for example metal salts of water-soluble compounds of the formula (1), are already used for the process of the present invention, it is advisable to add further alkaline compounds to the treatment liquors. Especially sodium hydroxide and potassium hydroxide are highly useful for this purpose. In place of the additional inclusion of these alkaline compounds in the treatment liquors, the process of the present invention can also be carried out in two stages. This is accomplished, for example, by a first stage of applying to the fibre materials a first aqueous treatment liquor which comprises a product of the formula (1) and has a pH at which this liquor has high stability, for example a pH of 7 to 10. This first aqueous treatment liquor may comprise further products, such as reactive dyes. This first treatment liquor can be applied by pad-mangling. After mangling, the fibre material is dried. The second stage comprises applying a second aqueous treatment liquor comprising the amount of alkaline compound necessary for the crosslinking with cellulose. This alkaline compound is preferably sodium hydroxide or potassium hydroxide. The application of the second liquor is followed by drying, for example at 80 to 130° C., during which the crosslinking takes place. The second treatment liquor can be, for example, an aqueous sodium hydroxide or potassium hydroxide solution of relatively high concentration, for example between 30 and 60% by weight.

At the temperatures employed, for example 80 to 130° C., the presence of alkaline compounds causes a crosslinking (curing) to take place with cellulose. For this reason, the treatment of the fibre materials with treatment liquid is preferably carried out at a pH within the range from 7 to 13 (measured at 20° C.).

The fibre materials treated by the process of the present invention are notable for good permanent finish effects, especially easy care, dimensional stability and shrink resistance.

The compounds used in the process of the present invention can be applied to the fibre material and fixed on the fibre in various ways, especially in the form of aqueous solutions, preferably by the exhaust method. After fixing, the treated fibre materials are thoroughly washed with cold and hot water, optionally in the presence of an agent which has a dispersing effect and promotes the diffusion of the unfixed portions.

The compounds of the formula (1) which contain a water-solubilizing group, for example a sulfo or sulfato group, are either present in the form of their free acid or preferably as their salts such as, for example, the alkali metal, alkaline earth metal or ammonium salts or as salts of an organic amine. Examples are the sodium, potassium, lithium or ammonium salts or the salt of triethanolamine.

The compounds of the formula (1) are either known or preparable similarly to known compounds. For instance, the compounds of the formula (1) are, for example, reactive dye precursors as disclosed in WO 96/00399 or can be prepared similarly thereto.

For the process of the present invention, the amounts in which the compounds of the formula (1) are used in the treatment baths, especially in the dyebaths together with dyes, preferably reactive dyes, can vary within wide limits. In general, amounts of 0.01 to 20% by weight, especially 0.1 to 15% by weight, on weight of fibre, are advantageous.

The treatment by the process of the present invention is preferably carried out by the exhaust method. The treatment generally takes place in an aqueous medium at a liquor ratio of, for example 2:1 to 60:1, especially 5:1 to 20:1. The temperature for the treatment ranges, for example, from 20 to 100° C., especially from 40 to 90° C., preferably from 55 to 80° C.

In a particular preferred embodiment of the process of the present invention, the crosslinking of the cellulosic fibre is carried out before dyeing or together with their dyeing, especially after manufacturing of the fibre.

In a particularly preferred embodiment of the process of the present invention, the crosslinking of the cellulosic fibre materials is carried out together with their dyeing.

The compounds of the formula (1) are notable for high reactivity, good fixing capacity and very good build-up capacity. They can therefore be applied by the exhaust dyeing method at low dyeing temperatures. The yields of fixation are high and the unfixed portions are readily washed off, the difference between the degree of exhaustion and the degree of fixation being remarkably small; i.e. the hydrolysis loss being very small.

The examples which follow illustrate the invention. Temperatures are reported in degrees Celsius. Parts and percentages are by weight, unless otherwise stated. Parts by weight relate to parts by volume as the kilogram relates to the liter.

EXAMPLE 1

10 g of viscose fabric is clamped at 50° C. into a laboratory exhaust dyeing machine together with 100 ml of a liquor comprising 8 g of Glauber salt and 1 g of a colourless compound of the formula (100) as per Table 1. After 10 minutes of agitation at 50° C., 2 g of anhydrous sodium carbonate are added in two portions. The viscose fabric is agitated for a further 20 minutes. The liquor temperature is raised to 60° C., and 0.2 ml of 30% sodium hydroxide solution is added. After 20 minutes, the bath is dropped and the viscose fabric is rinsed cold, washed out at the boil and rinsed cold once more and dried. The result obtained is a viscose fabric having higher dimensional stability and higher wet abrasion resistance.

EXAMPLE 2

10 g of viscose fabric is clamped at 50° C. into a laboratory exhaust dyeing machine together with 100 ml of a liquor comprising 8 g of Glauber salt and 1 g of a colourless compound of the formula (100) as per Table 1 and 0.1 g of the dye of the formula (200) as per Table 2. After 20 minutes of agitation at 50° C., 2 g of anhydrous sodium carbonate are added in two portions. The viscose fabric is agitated for a further 10 minutes. The liquor temperature is raised to 60° C., and 0.2 ml of 30% sodium hydroxide solution is added. After 20 minutes, the bath is dropped and the viscose fabric is rinsed cold, washed out at the boil and rinsed cold once more and dried. The result obtained is a navy viscose fabric having higher dimensional stability and higher wet abrasion resistance.

Replacing in Example 1 the compound of the formula (100) with other compounds indicated in Table 1 likewise affords a viscose fabric having the reported advantageous properties.

Replacing in Example 2 the dye of the formula (200) with the dye of the formula (201) affords a red viscose fabric having the reported advantageous properties.

Replacing in Example 2 the compound of the formula (100) with other compounds specified in Table 1 likewise affords a viscose fabric having the reported advantageous properties.
TABLE 1
| Colourless compounds as per the formula (1) in the form of the free acid | |
|---|---|
| 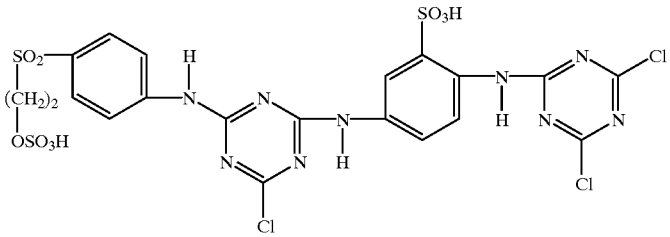 | (100) |
| 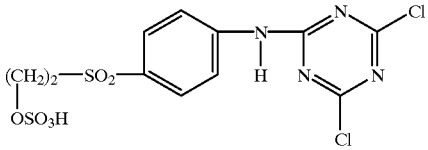 | (101) |
| 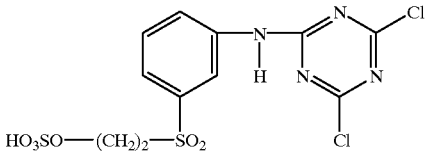 | (102) |
| 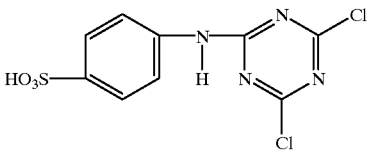 | (103) |
| 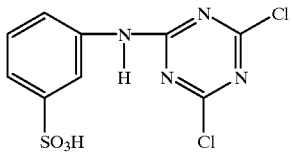 | (104) |
| 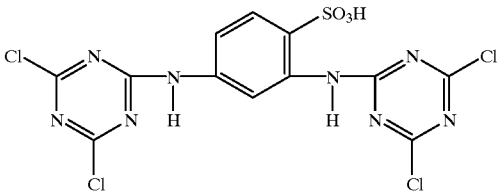 | (105) |
| 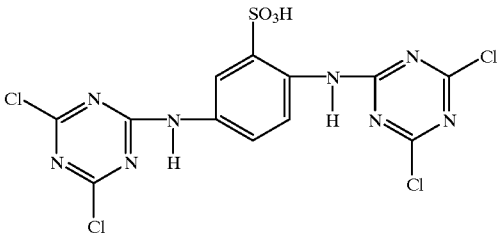 | (106) |

TABLE 1-continued

| Colourless compounds as per the formula (1) in the form of the free acid | |
|---|---|
| 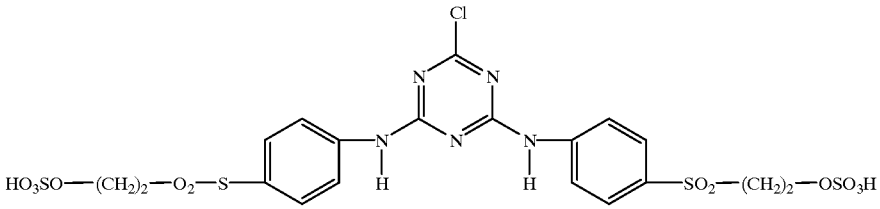 | (107) |

TABLE 2

| Dyes in the form of the free acid of the formula | |
|---|---|
| 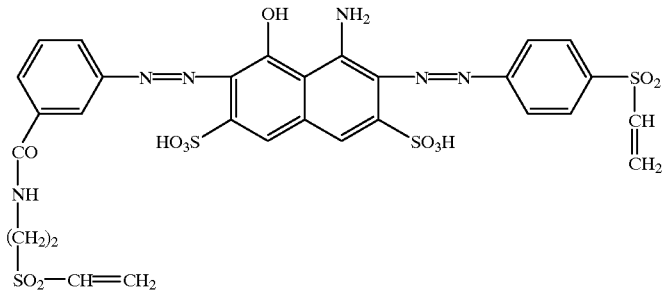 | (200) |
| 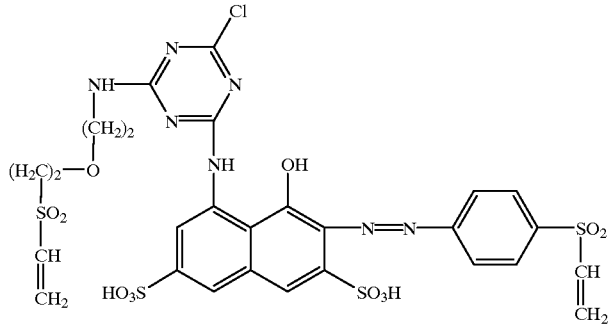 | (201) |

EXAMPLE 3

18.5 g of cyanuric chloride are introduced into a mixture consisting of 100 g of finely ground ice and 50 ml of water comprising 0.6 g of a commercially available surfactant and wetted for 15 minutes. Then, with thorough stirring, 6.1 g of ethanolamine are added dropwise in such a way that the pH of the mixture is maintained at about 8. On completion of the addition of ethanolamine about 8 g of 50% aqueous NaOH solution are added dropwise in such a way that the pH is maintained at 8. The resulting fine suspension is filtered off and dried, affording 15.5 g of a white pulverulent compound of the formula

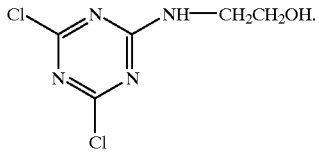 (108)

EXAMPLE 4

Example 3 is repeated with the 6.1 g of ethanolamine replaced by an equivalent amount of one of the amines specified in Table 3. The compounds recited in Table 3 are obtained.

TABLE 3

| Amine of formula | Compound of formula |
|---|---|
| $NH_2—CH_2CH_2OCH_2CH_2OH$ | 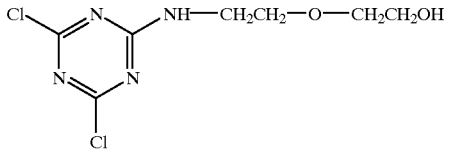 |
| $NH_2—CH_2CH(OH)CH_2OH$ | 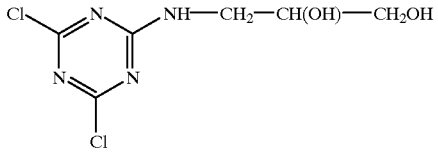 |
| $NH_2—CH_2CH_2CON(CH_2CH_2OH)_2$ | 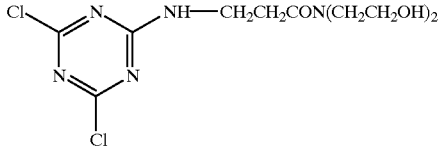 |
| $NH_2—CH_2CH_2CH_2CONHCH_2CH_2CH_2OH$ | 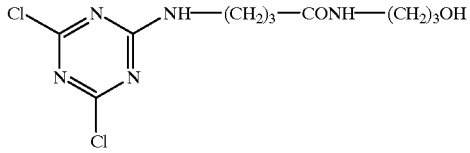 |
| $NH_2—CH_2CH_2NHCONHCH_2CH_2OH$ | 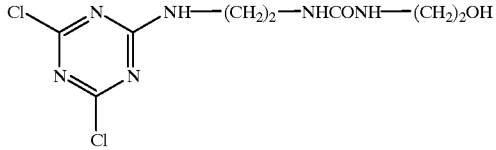 |
| $NH_2—CH_2CH_2CH_2SO_2NHCH_2CH_2CH_2OH$ | 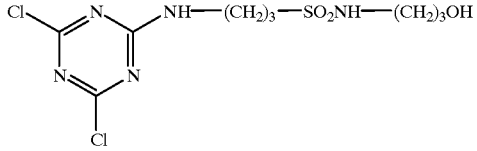 |
| $NH_2—CH_2CH_2NHSO_2CH_2CH_2CH_2OH$ | 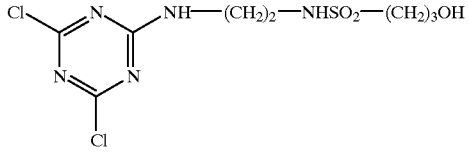 |
| $NH_2—CH_2CH_2NHSO_2CH_2CH_2CH_2CH_2OH$ | 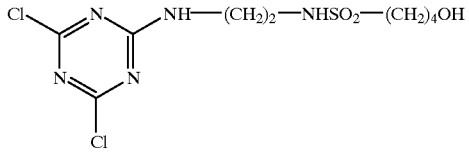 |

EXAMPLE 5

10 g of viscose fabric is clamped at 50° C. into a laboratory exhaust dyeing machine together with 100 ml of a liquor comprising 8 g of Glauber salt and 1 g of the first compound in Table 3 and 0.1 g of the dye of the formula (200) as per Table 2. After 20 minutes of agitation at 50° C., 2 g of anhydrous sodium carbonate are added in two portions. The viscose fabric is agitated for a further 10 minutes. The liquor temperature is raised to 60° C., and 0.2 ml of 30% sodium hydroxide solution is added. After 20 minutes, the bath is dropped and the viscose fabric is rinsed cold, washed out at the boil and rinsed cold once more and dried. The result obtained is a navy viscose fabric having higher dimensional stability and higher wet abrasion resistance.

EXAMPLE 6

An aqueous suspension comprising, per liter, 85 g of the colourless compound of the formula (100) is mixed in equal parts by volume of an aqueous alkaline solution comprising, per liter, 140 ml of 38°Bé watergloss and 20 g of sodium hydroxide and the mixture is then immediately padded onto a cotton fabric with a wet pick-up of 70 to 75%. The fabric thus treated is then immediately treated at 110° C. with hot air for 5 minutes, the alkali is removed by rinsing with cold and hot water, and the fabric is then dried once more. The result obtained is a fabric having significantly improved creasing properties.

EXAMPLE 7

An aqueous suspension comprising per liter 85 g of the colourless compound of the formula (100) is mixed in equal parts by volume with an aqueous alkaline solution comprising per liter 60 g of calcined sodium carbonate and the mixture is then immediately padded onto a cotton fabric with a wet pick-up of 70 to 75%. The fabric thus treated is then immediately dried at 130° C. with hot air for 2 minutes, treated at 102° C. with saturated steam for 8 minutes, the alkali is removed by rinsing with cold and hot water, and the fabric is dried once more. The result obtained is a fabric having significantly improved creasing properties.

What is claimed is:

1. A process for crosslinking cellulosic fibre materials, which comprises applying to the cellulosic fibre materials in which the cellulosic fibres comprise natural or regenerated cellulose at least one product of the general formula (1)

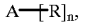

(1)

wherein

A is a colourless aliphatic, aromatic or heteroaromatic radical,

R is a fibre-reactive radical of the formula

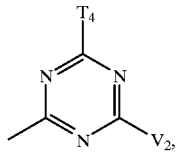

(3)

where $T_4$ is fluorine, chlorine or carboxypyridinium and $V_2$ is a radical of the formula

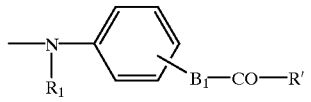

(4)

where $R_1$ is hydrogen or $C_1$–$C_4$alkyl which is optionally substituted by halogen, hydroxyl, cyano, $C_1$–$C_4$alkoxy, $C_1$–$C_4$alkoxycarbonyl, carboxyl, sulfamoyl, sulfo or sulfato;

$B_1$ is a direct bond or a radical

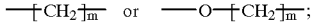

m is 1, 2, 3, 4, 5 or 6; and

R' is a radical of the formula

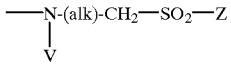

(4a)

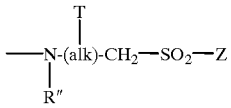

(4b)

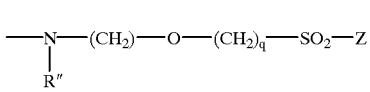

(4c)

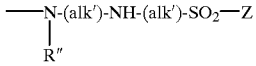

(4d)

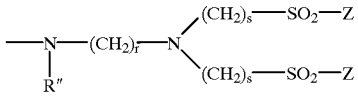

(4e)

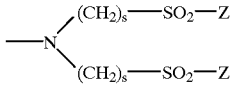

or (4f)

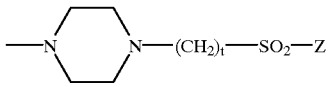

(4g)

where R" is hydrogen or $C_1$–$C_6$alkyl, alk is an alkylene radical having 1 to 7 carbon atoms, T is hydrogen, halogen, hydroxyl, sulfato, carboxyl, cyano, $C_1$–$C_4$-alkanoyloxy, $C_1$–$C_4$-alkoxycarbonyl, carbamoyl or a radical —$SO_2$—Z, V is hydrogen, substituted or unsubstituted $C_1$–$C_4$alkyl or a radical of the formula

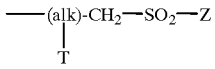

(4h)

where (alk) is as defined above, each alk' is independently a polymethylene radical having 2 to 6 carbon atoms, Z is β-sulfatoethyl, β-thiosulfatoethyl, β-phosphatoethyl, β-acyloxyethyl, β-haloethyl or vinyl, r and t are each independently 1, 2, 3, 4, 5 or 6 and s is 2, 3, 4, 5 or 6;

and the benzene ring in the formula (4) optionally contains further substituents; or where $V_2$ is a directly attached radical of the formula (4a), (4b), (4c), (4d), (4e), (4f) or (4g) where R', T, alk, V, alk', Z, p, q, r, s and t are each as defined above; or where $V_2$ is a radical of the formula (4')

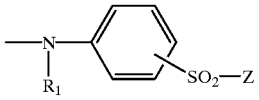

where $R_1$ and Z are each as defined above and the benzene ring is optionally further substituted, and n is 1, 2, 3 or 4.

2. A process according to claim 1, wherein the compound of the formula (1) is applied to the fibre together with reactive dyes.

3. An aqueous solution or dispersion comprising at least one compound of the formula (1) as set forth in claim 1.

4. A process for crosslinking cellulosic fibre materials, which comprises applying to the cellulosic fibre materials in which the cellulosic fibres comprise natural or regenerated cellulose at least one product, shown in the form of the free acid, of the formula (100)

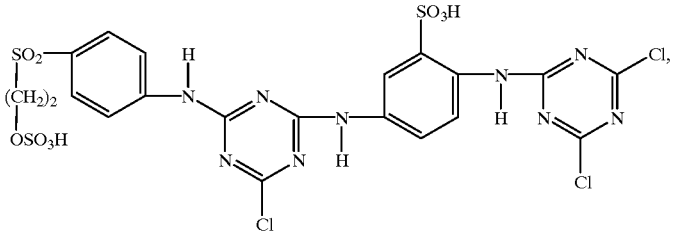

(101)

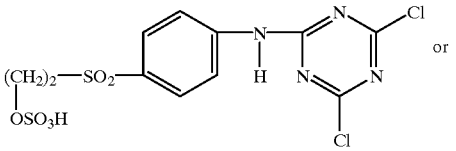

or (102)

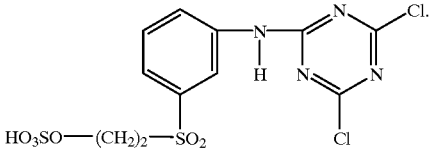

5. A process according to claim 4, wherein the compound of the formula (100), (101) or (102) is applied to the fibre together with reactive dyes.

6. An aqueous solution or dispersion comprising at least one compound of the formula (100), (101) or (102) as set forth in claim 4.

* * * * *